US010098471B2

(12) United States Patent
Li et al.

(10) Patent No.: US 10,098,471 B2
(45) Date of Patent: Oct. 16, 2018

(54) SOFA PILLOW DRIVING DEVICE

(71) Applicant: Remacro Machinery & Technology (Wujiang) Co., Ltd., Suzhou, Jiangsu (CN)

(72) Inventors: Xiaohong Li, Jiangsu (CN); Haibo Wang, Jiangsu (CN); Jiao Chen, Jiangsu (CN); Zhong Pang, Jiangsu (CN); Linlin Wu, Jiangsu (CN)

(73) Assignee: Remacro Machinery & Technology (Wujiang) Co., Ltd., Suzhou (CN)

( * ) Notice: Subject to any disclaimer, the term of this patent is extended or adjusted under 35 U.S.C. 154(b) by 10 days.

(21) Appl. No.: 15/376,703

(22) Filed: Dec. 13, 2016

(65) Prior Publication Data

US 2018/0125248 A1 May 10, 2018

(30) Foreign Application Priority Data

Nov. 8, 2016 (CN) ..... 2016 1 0979820

(51) Int. Cl.
*A47C 7/38* (2006.01)
*A47C 17/04* (2006.01)

(52) U.S. Cl.
CPC ..... *A47C 17/04* (2013.01); *A47C 7/38* (2013.01)

(58) Field of Classification Search
CPC ..... A47C 17/04; A47C 7/38; A47C 20/04; A47C 20/041
See application file for complete search history.

(56) References Cited

U.S. PATENT DOCUMENTS

| | | | | |
|---|---|---|---|---|
| 7,862,110 | B2 * | 1/2011 | Rogers | A47C 1/036 297/391 |
| 8,615,828 | B2 * | 12/2013 | Schermel | A47C 20/04 297/411.31 |
| 8,997,274 | B2 * | 4/2015 | Phillips | A47C 1/0242 5/37.1 |
| 9,282,827 | B1 * | 3/2016 | Lu | A47C 20/041 |
| 9,681,751 | B2 * | 6/2017 | Lu | A47C 7/38 |
| 2005/0029853 | A1 * | 2/2005 | Gauthier | A47C 7/38 297/408 |
| 2009/0100600 | A1 * | 4/2009 | Unger | A47C 20/041 5/618 |
| 2016/0227934 | A1 * | 8/2016 | Lu | F16H 21/44 |
| 2016/0331145 | A1 * | 11/2016 | Baumeister | A47C 1/036 |
| 2017/0127844 | A1 * | 5/2017 | Grone | A47C 7/38 |
| 2018/0027979 | A1 * | 2/2018 | Zhao | A47C 20/041 |

* cited by examiner

*Primary Examiner* — Philip F Gabler

(57) ABSTRACT

The present invention discloses a sofa pillow driving device, which comprises a side plate mounting member, a headrest mounting member, and a driving device, the sofa pillow driving device further comprises a rotation limit member and an elastic member, the rotation limit member being rotatably connected to the side plate mounting member, the headrest mounting member being rotatably connected to the rotation limit member, one end of the elastic member being connected to the headrest mounting member and the other end being connected to the rotation limit member, one end of the driving device being rotatably connected to the rotation limit member and the other end being rotatably connected to a backrest wood frame, the driving device drives the headrest mounting member to rotate by the rotation limit member.

7 Claims, 9 Drawing Sheets

SOFA PILLOW DRIVING DEVICE

CROSS-REFERENCE TO RELATED APPLICATIONS

The present application claims the benefit of Chinese Patent Application No. 201610979820.9 filed on Nov. 8, 2016, the contents of which are hereby incorporated by reference.

FIELD OF THE INVENTION

The present invention relates to the field of furniture, and more particularly, to a sofa pillow driving device.

BACKGROUND OF THE INVENTION

The prior art sofa pillow driving device is pushed by a driving device indirectly when being pushed away, and is folded by a spring when being retracted, such a structure design may result in that the two sides of the headrest are not uniformly stressed, and the distance between the two sides when the headrest is opened varies obviously, the headrest is difficult to fully fit when being retracted by a spring, and more particularly, retracting the headrest back by a spring may result in that retracting on the left side and retracting on the right side are asynchronous when the sofa has a large width.

SUMMARY OF THE INVENTION

It is an object of the present invention to provide a sofa pillow driving device that is pushed away and retracted by a driving device directly, capable of solving the problem of the distance between the two sides when the headrest is opened varying obviously and the pillow being difficult to fully fit when being retracted, so as to overcome shortcomings of the prior art.

The object of the present invention is achieved by the following technical scheme.

A sofa pillow driving device comprises a side plate mounting member, a headrest mounting member, and a driving device, the sofa pillow driving device further comprises a rotation limit member and an elastic member, the rotation limit member being rotatably connected to the side plate mounting member, the headrest mounting member being rotatably connected to the rotation limit member, one end of the elastic member being connected to the headrest mounting member and the other end being connected to the rotation limit member, one end of the driving device being rotatably connected to the rotation limit member and the other end being rotatably connected to a backrest wood frame, the driving device driving the headrest mounting member to rotate by the rotation limit member.

Preferably, the rotation limit member is provided with a second rotation connecting hole, the rotation limit member being rotatably connected to the side plate mounting member by a rotation shaft passing through the second rotation connecting hole.

Preferably, the rotation limit member is further provided with a sliding groove, the side plate mounting member is provided with a second fixing hole, one end of a banking pin being fixed in the second fixing hole and the other end being provided in the sliding groove and being slidable in the sliding groove.

Preferably, the rotation limit member is further provided with a third rotation connecting hole, the headrest mounting member being rotatably connected to the rotation limit member by a rotation shaft passing through the third rotation connecting hole.

Preferably, the head mounting member is provided with a first spring hanging hole, the rotation limit member is further provided with a second spring hanging hole, one end of the elastic member being hanging on the first spring hanging hole and the other end being hanging on the second spring hanging hole.

Preferably, the side plate mounting member is further provided with a first rotation connecting hole, the rotation limit member is further provided with a fourth rotation connecting hole, one end of the driving device being rotatably connected to the side plate mounting member by a rotation shaft passing through the first rotation connecting hole and the other end being rotatably connected to the rotation limit member by a rotation shaft passing through the fourth rotation connecting hole.

Preferably, the rotation limit member is further provided a fourth fixing hole, a first mounting bracket being fixedly connected to the rotation limit member by the fourth fixing hole, the first mounting bracket being provided a fifth rotation connecting hole, the upper end of the driving device being rotatably connected to the first mounting bracket by a rotation shaft passing through the fifth rotating connecting hole, and the lower end of the driving device being connected to a second mounting bracket that is fixedly mounted on the backrest wood frame.

Preferably, the side plate mounting member is further provided with several first fixing holes through which the side plate mounting member is fixedly mounted on the backrest wood frame.

Preferably, headrest mounting member is further provided with several third fixing holes through which a headrest plate is fixedly mounted on the headrest mounting member.

Compared with the prior art, the invention has the following advantages.

The sofa pillow driving device of the present invention may achieve the opening and retraction of the backrest and headrest of the sofa by cooperation and connection of five components, that is, the side plate mounting member, the headrest mounting member, the rotation limit member, the elastic member, and the driving device, with structure simple, manufacture cost low, and being easy to popularize. The headrest plate may be opened and retracted by the driving device, ensuring that the two ends of the sofa are uniformly stressed, so the distance between the two ends of the sofa is almost the same when the headrest plate is opened, the actions of the two ends of the sofa are substantially synchronous when the headrest plate is retracted, and the headrest plate is folded to the position of the backrest. The headrest mounting member can also rotate around the rotation limit member under external force, without being affected by the movement of the driving device, to prevent the hand from being trapped.

Figure 1:
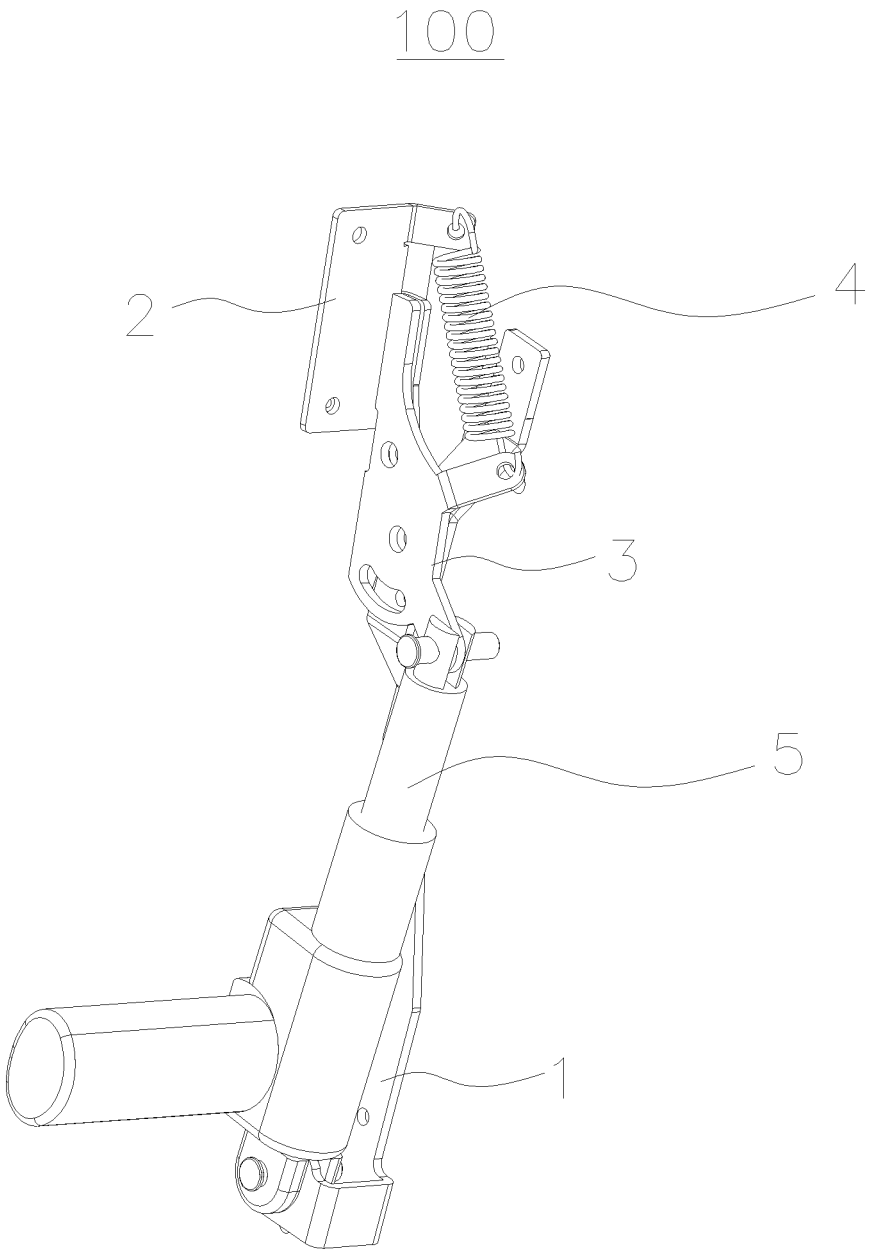
FIG. 1 is a structural view of a sofa pillow driving device according to a first embodiment of the present invention.

100 Sofa pillow driving device
1 Side plate mounting member
11 First fixing hole
12 Second fixing hole
13 First rotation connecting hole
14 Banking pin
2 Headrest mounting member
21 Third fixing hole
22 First spring hanging hole
3 Rotation limit member
31 Second rotation connecting hole
32 Sliding groove
321 First limit edge
322 Second limit edge
33 Third rotation connecting hole
34 Second spring hanging hole
35 Fourth rotation connecting hole
36 Third limit edge
37 Fourth fixing hole
4 Elastic member
5 Driving device
200 Backrest wood frame
300 Headrest plate
400 First mounting bracket
40 Fifth rotation connecting hole
500 Second mounting bracket
50 Sixth rotation connecting hole

DETAILED DESCRIPTION OF THE INVENTION

In the following, the invention will be further described in conjunction with the accompanying drawings and the detailed description.

Figure 2:
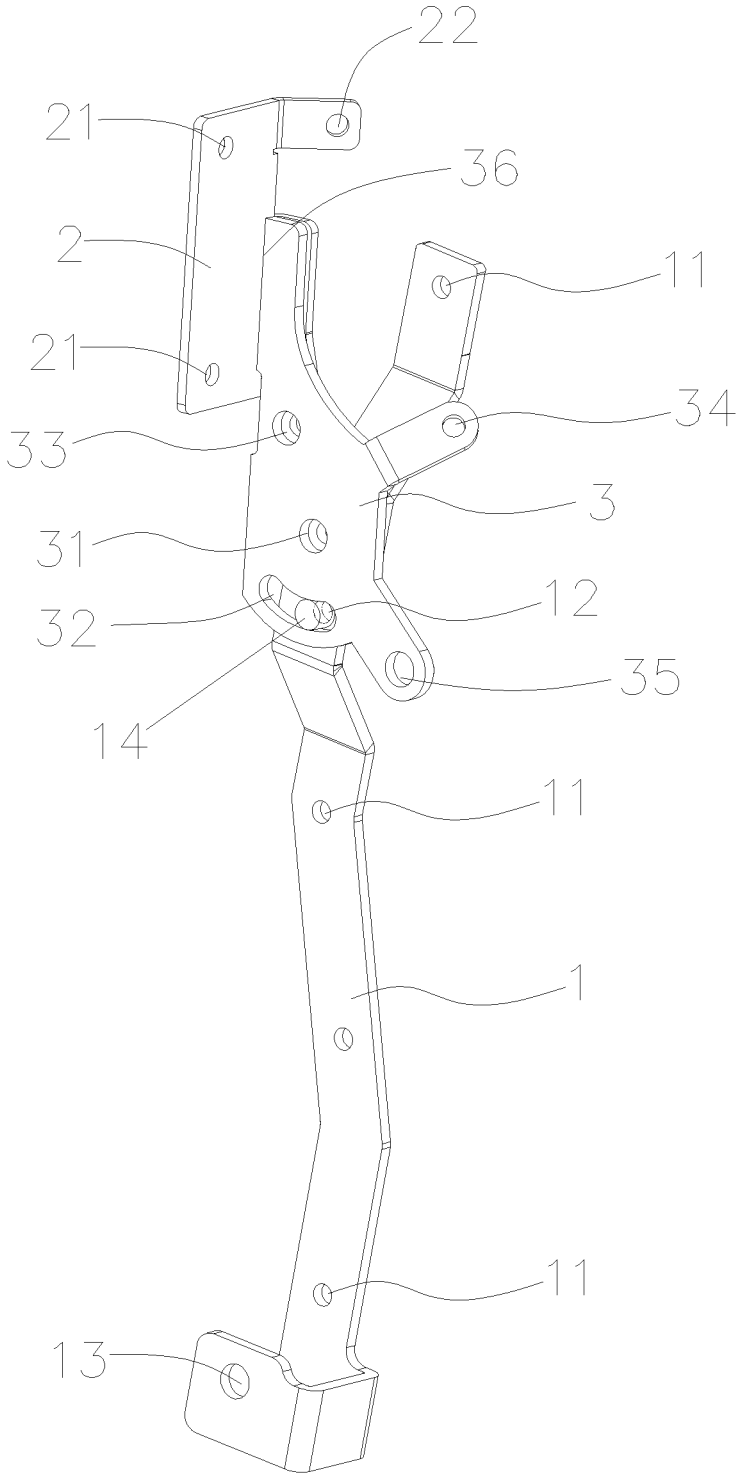
FIG. 2 is an internal structural view of the sofa pillow driving device shown in FIG. 1.
Figure 3:
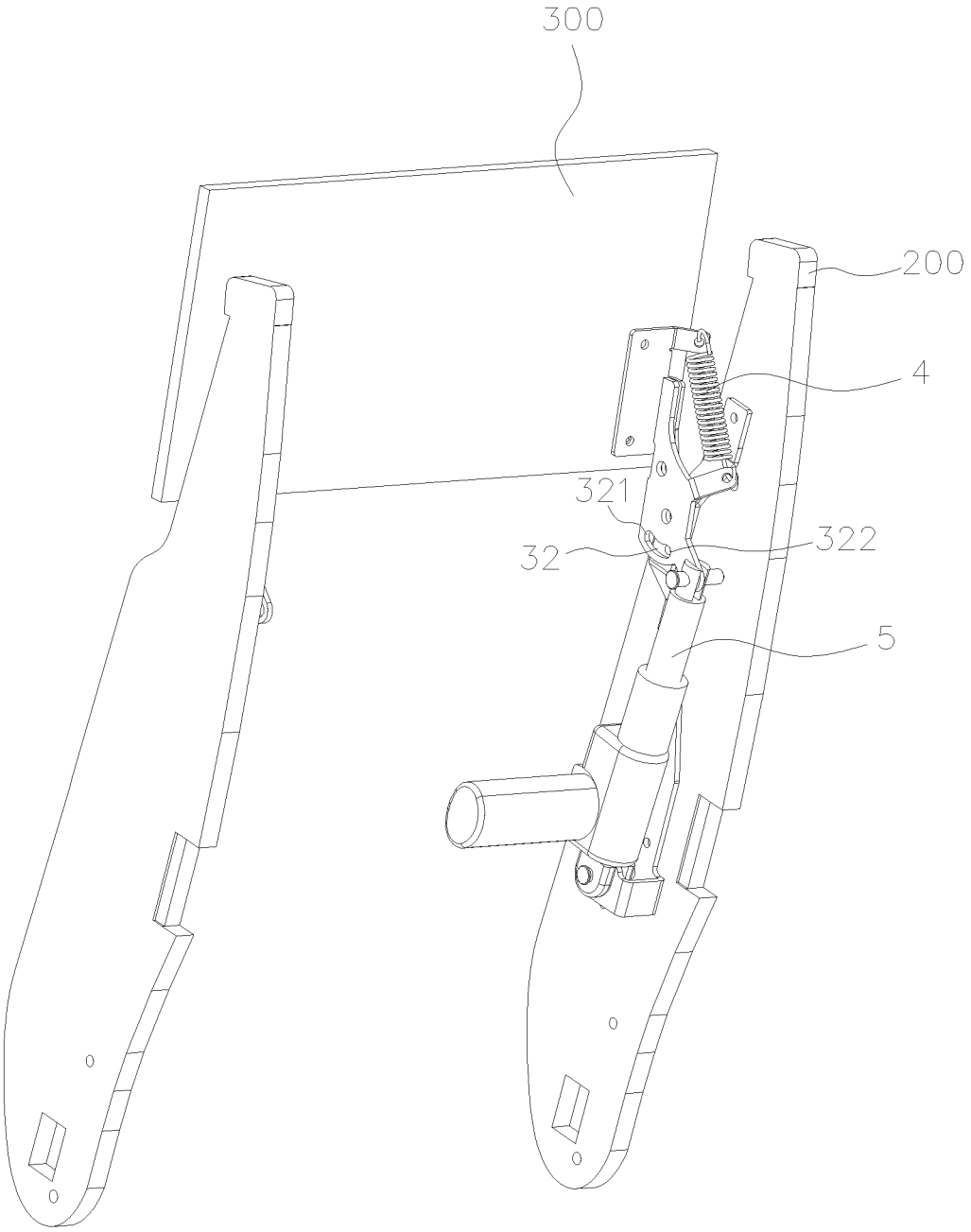
FIG. 3 is a schematic view of the sofa pillow driving device shown in FIG. 1 in a using state.

As shown in FIGS. 1 to 3, the sofa pillow driving device 100 according to the first embodiment of the present invention comprises a side plate mounting member 1, a headrest mounting member 2, a rotation limit member 3, an elastic member 4, and a driving device 5. The rotation limit member 3 is rotatably connected to the side plate mounting member 1, the headrest mounting member 2 is rotatably connected to the rotation limit member 3, one end of the elastic member 4 is connected to the headrest mounting member 2 and the other end is connected to the rotation limit member 3, one end of the driving device 5 is rotatably connected to the rotation limit member 3 and the other end is rotatably connected to the side plate mounting member 1.

The side plate mounting member 1 is provided with several first fixing holes 11, a second fixing hole 12, a rotation connecting hole 13, the several first fixing holes 11 are provided in the length direction of the side plate mounting member 1, the rotation connecting hole 13 is located at the lower part of the side plate mounting member 1, and a banking pin 14 is fixed in the second fixing hole 12.

The headrest mounting member 2 is provided with several third fixing holes 21 and a first spring hanging hole 22, the several third fixing holes 21 are provided in the length direction of the headrest mounting member 2.

The rotation limit member 3 is provided with a second rotation connecting hole 31, a sliding groove 32, a third rotation connecting hole 33, a second spring hanging hole 34, and a fourth rotation connecting hole 35. In addition, the rotation limit member 3 is provided with a third limit edge 36. The sliding groove 32 comprises a first limit edge 321 and a second limit edge 322 located at opposite sides.

The assembly method of respective parts of the sofa pillow driving device 100 is as follows.

The rotation limit member 3 is rotatably connected to the side plate mounting member 1 by a rotation shaft (not shown) passing through the second rotation connecting hole 31, one end of the banking spin 14 is fixed in the second fixing hole 12 and the other end is provided in the sliding groove 32 and is slidable in the sliding groove 32. The headrest mounting member 2 is rotatably connected to the rotation limit member 3 by a rotation shaft (not shown) passing through the third rotation connecting hole 33. One end of the elastic member 4 is hanged in the first spring hanging hole 22 and the other end is hanged in the second spring hanging hole 34. One end of the driving device 5 is rotatably connected to the side plate mounting member 1 by a rotation shaft passing through the first rotation connecting hole 13 and the other end is rotatably connected to the rotation limit member 3 by a rotation shaft passing through the fourth rotation connecting hole 35.

In the present embodiment, two sofa pillow driving devices 100 are cooperatively used, that is, the backrest wood frames 200 on both sides of the sofa are each installed a sofa pillow driving device 100, only one sofa pillow driving device 100 having the driving device 5 installed thereon.

The working principle of the sofa pillow driving device 100 is as follows.

Figure 4:
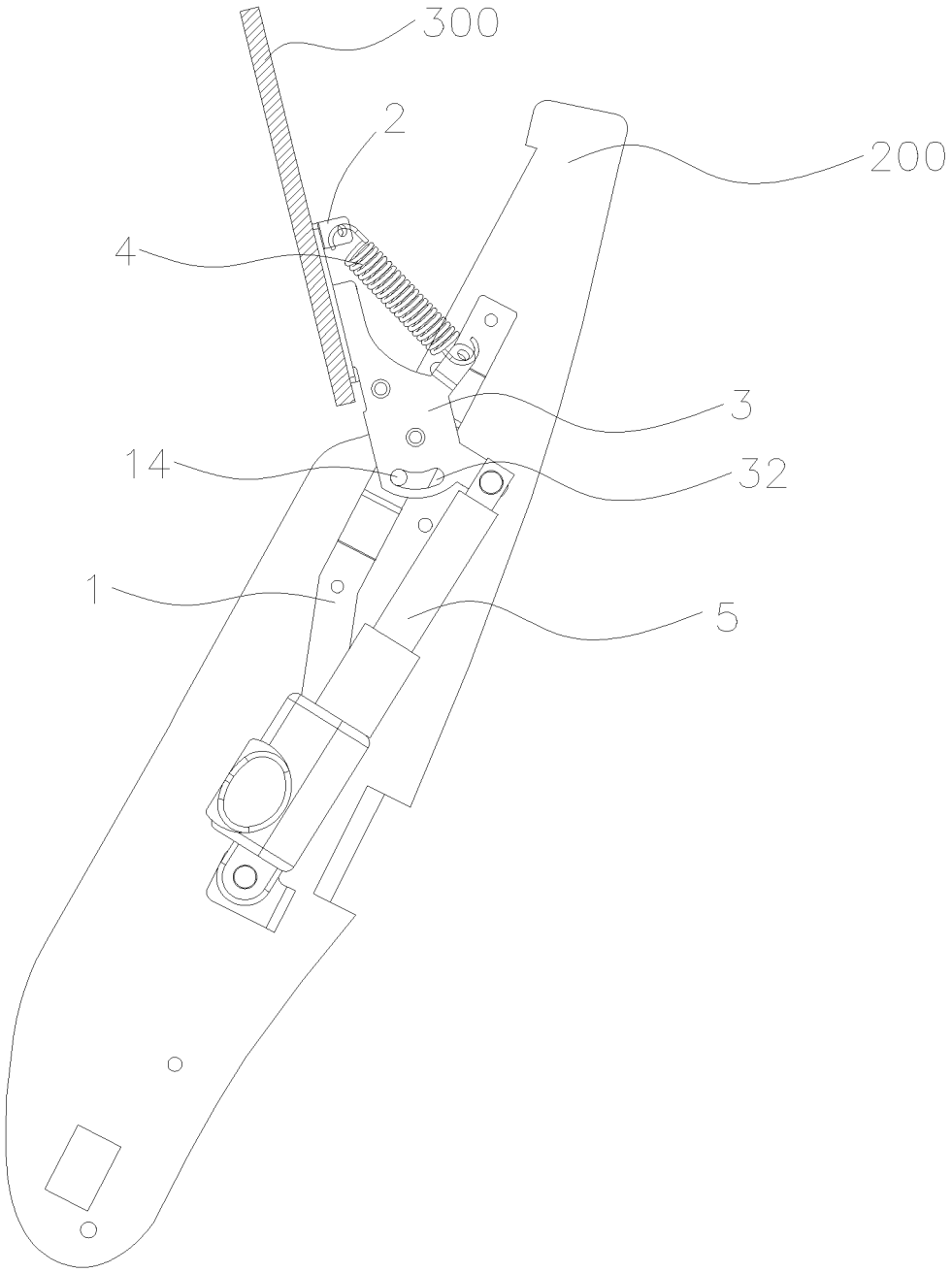
FIG. 4 is a schematic view of the sofa pillow driving device shown in FIG. 1 in a fully opened state.
Figure 5:
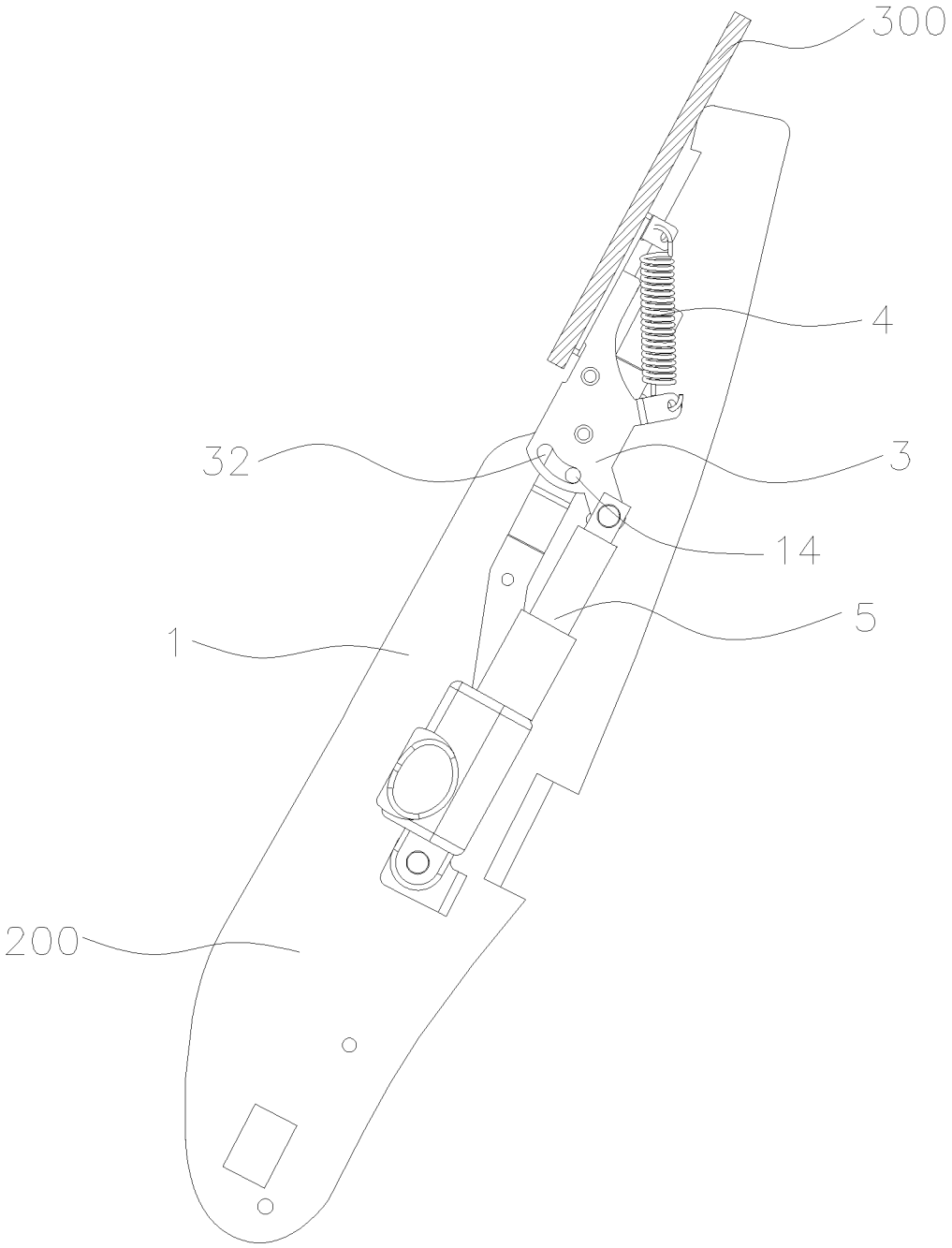
FIG. 5 is a schematic view of the sofa pillow driving device shown in FIG. 1 in a fully folded state.

As shown in FIG. 4, when the driving device 5 is activated, the rotation limit member 3 is promoted to rotate around the side plate mounting member 1, and the rotation limit member 3 drives the headrest mounting member 2 to rotate synchronously, the banking pin 14 slides in the sliding groove 32 simultaneously, and when the banking pin 14 is brought into contact with the first limit edge 321, the headrest mounting member 2 is opened to the maximum extent. As shown in FIG. 5, when the driving device 5 is retracted, the rotation limit member 3 is drived to rotate around the side plate mounting member 1 reversely, and the rotation limit member 3 drives the headrest mounting member 2 to rotate synchronously, the banking pin 14 slides in the sliding groove 32 simultaneously, and when the banking pin 14 is brought into contact with the second limit edge 322, the headrest mounting member 2 is folded to the minimum extent so as to be tightly affixed to the third limit edge 36. In the process of opening and retraction by the driving device 5, the elastic member 4 does not generate a variation in force.

Figure 6:
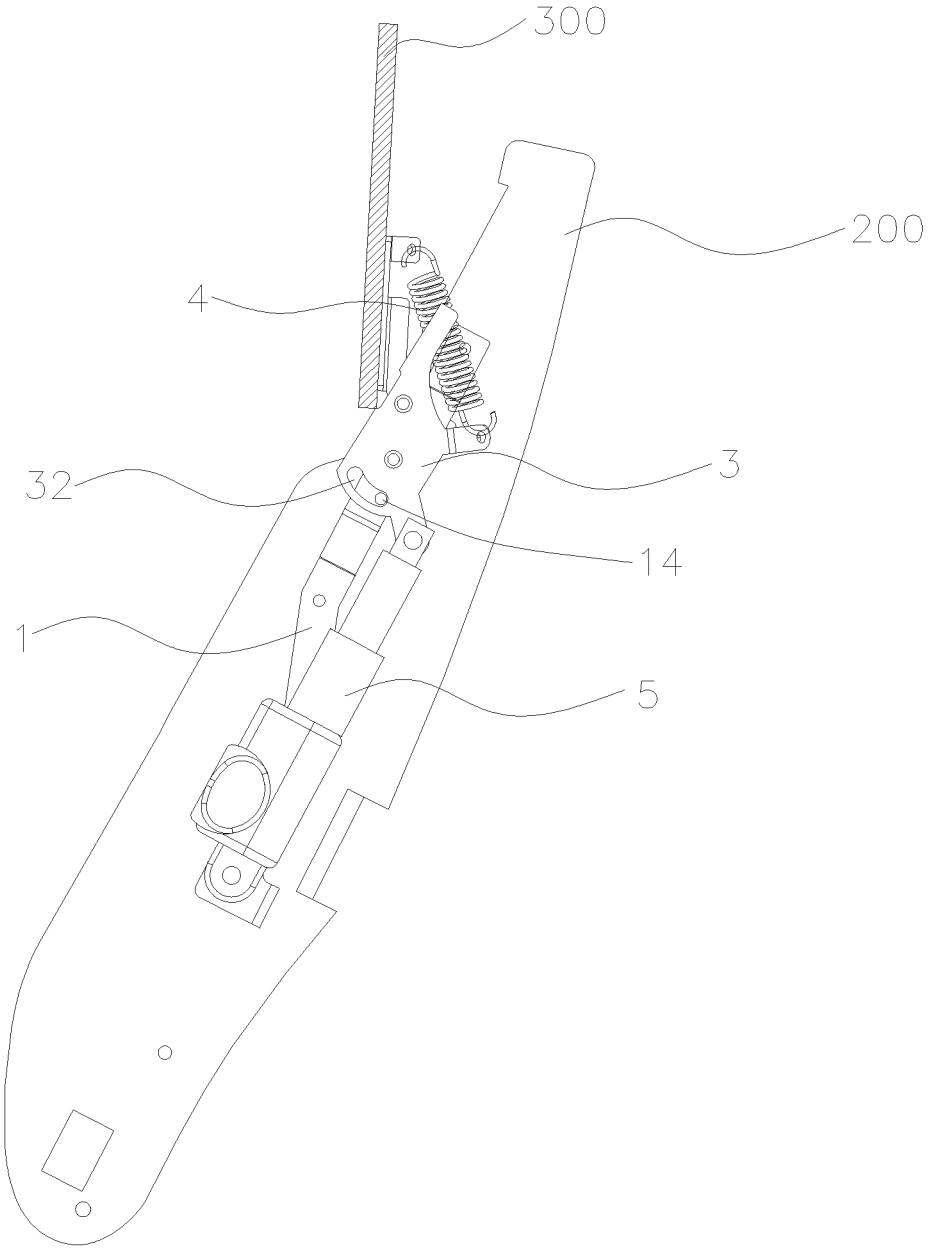
FIG. 6 is a schematic view of the sofa pillow driving device shown in FIG. 1 in a manually opened state.

As shown in FIG. 6, the headrest mounting member 2 may rotate around the rotation limit member 3 by an external force such as a pulling force of the hand, at this time, the elastic member 4 is stretched, and when the external force is cancelled, the headrest mounting member 2 is returned to its original position by the tension of the elastic member 4, without the movement process being affected by the movement of the driving device 5.

Figure 7:
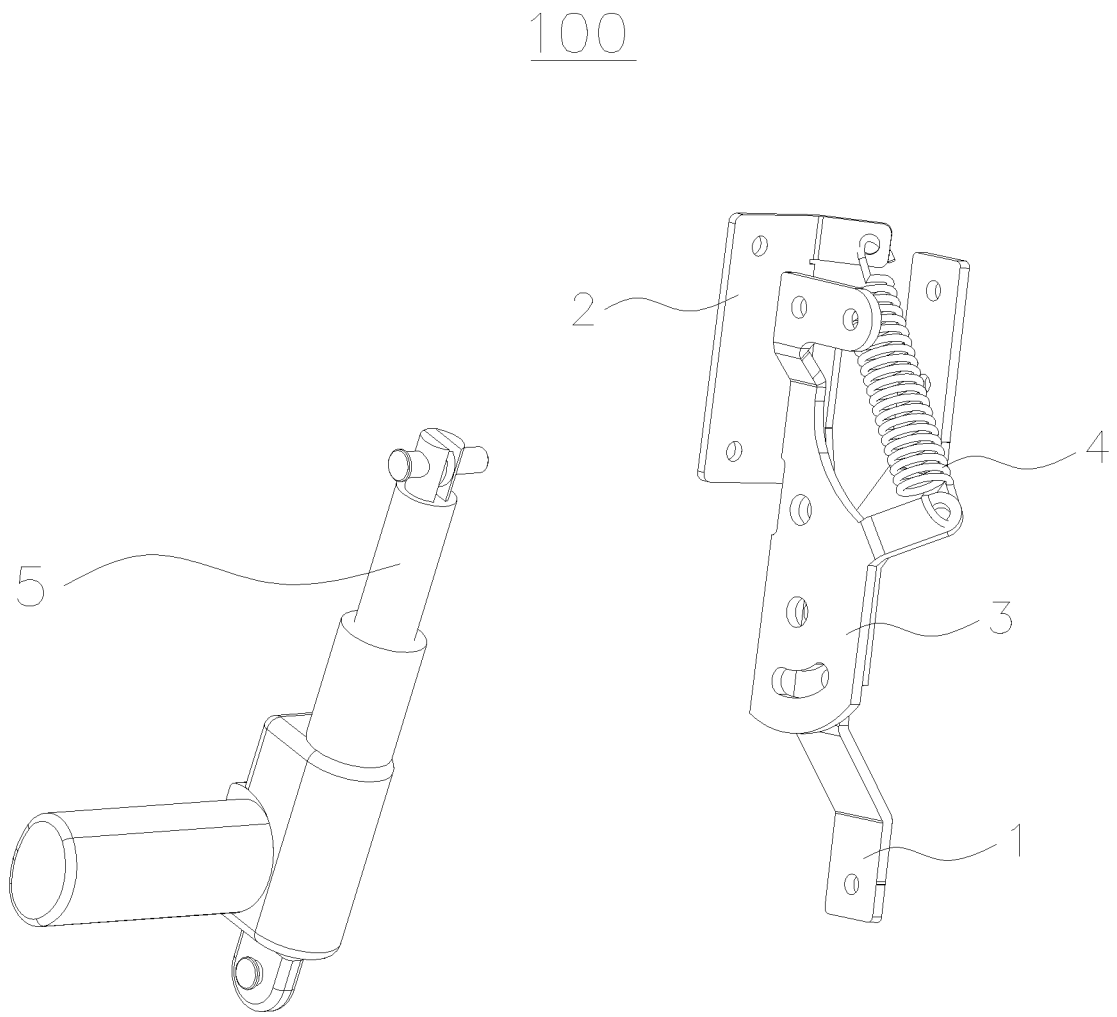
FIG. 7 is a structural view of a sofa pillow driving device according to a second embodiment of the present invention.
Figure 8:
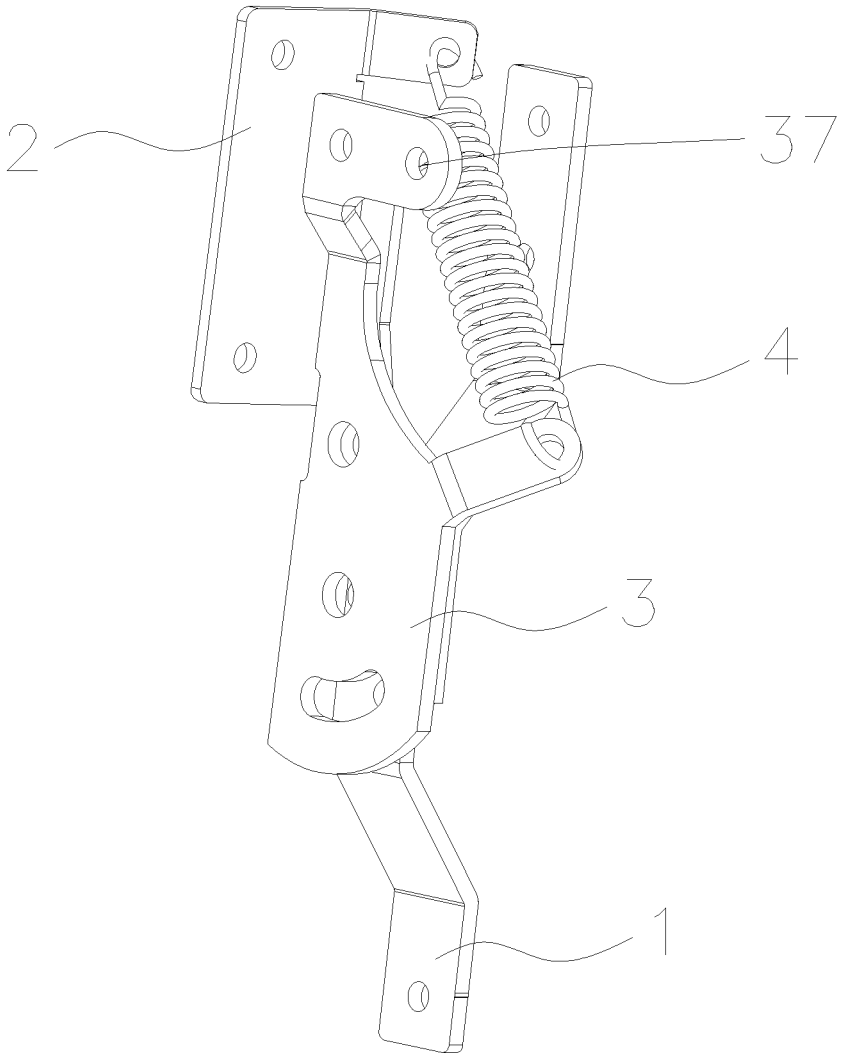
FIG. 8 is an internal structural view of the sofa pillow driving device shown in FIG. 7.
Figure 9:
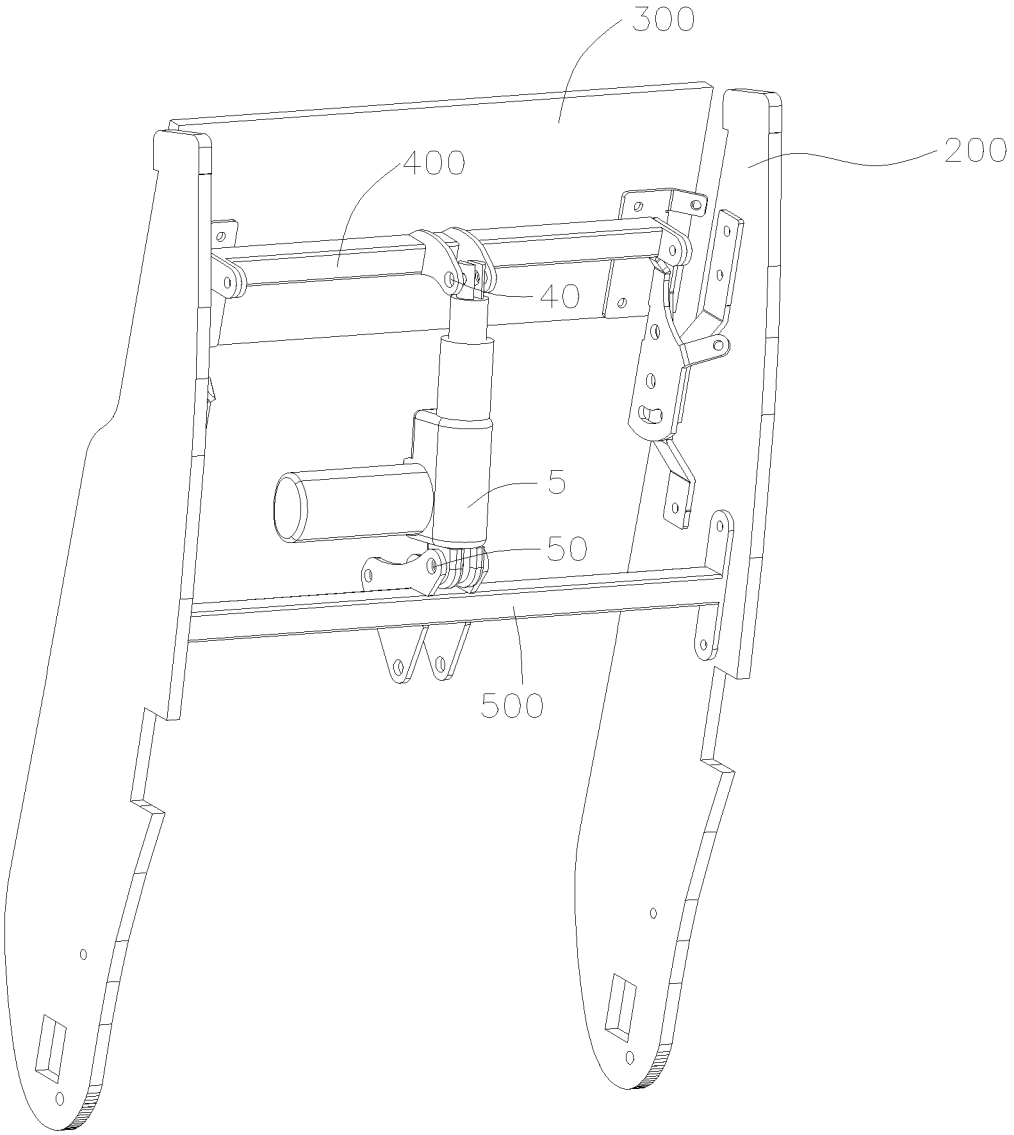
FIG. 9 is a schematic view of the sofa pillow driving device shown in FIG. 7 in a using state.

As shown in FIGS. 7 to 9, the sofa pillow driving device 100 according to the second embodiment of the present invention has a structure that is basically the same as that of the sofa pillow driving device described in the first embodiment, except that the rotation limit member 3 is not provided with the first rotation connecting hole, but provided with several fourth fixing holes 37 through which the first mounting bracket 400 is fixedly connected to the rotation limit member 3, the first mounting bracket 400 is provided with a fifth rotation connecting hole 40, the upper end of the driving device 5 is rotatably connected to the first mounting bracket 400 by a rotation shaft (not shown) passing through the fifth rotation connecting hole 40, and the lower end of the driving device 5 is rotatably connected to a second mounting bracket 500. Specifically, the second mounting bracket 500 is provided with a sixth rotation connecting hole 50, the lower end of the driving device 5 is rotatably connected to the second mounting bracket 500 by a rotation shaft (not shown) passing through the sixth rotation connecting hole 50, and the second mounting bracket 500 is fixedly mounted on the backrest wood frame 200.

The working principle of the sofa pillow driving device 100 is as follows.

When the driving device 5 is activated, the first mounting bracket 400 is promoted to rotate and drives the rotation limit member 3 to rotate around the side plate mounting member 1, the rotation limit member 3 drives the headrest mounting member 2 to rotate synchronously, the banking pin 14 slides in the sliding groove 32 simultaneously, and when the banking pin 14 is brought into contact with the first limit edge 321, the headrest mounting member 2 is opened to the maximum extent. When the driving device 5 is retracted, the driving device 5 drives the first mounting bracket 400 to retract, the first mounting bracket 400 drives the rotation limit member 3 to rotate around the side plate mounting member 1 reversely, and the rotation limit member 3 drives the headrest mounting member 2 to rotate synchronously, the banking pin 14 slides in the sliding groove 32 simultaneously, and when the banking pin 14 is brought into contact with the second limit edge 322, the headrest mounting member 2 is folded to the minimum extent so as to be tightly affixed to the third limit edge 36. In the process of opening and retraction by the driving device 5, the elastic member 4 does not generate a variation in force.

Preferably, the elastic member 4 is a spring, and the driving device 5 is a motor.

The sofa pillow driving device 100 is an internal component of a sofa, and the sofa pillow driving device 100 is fixedly mounted to a backrest wooden frame 200 at both sides of a sofa by a first fixing hole 11 on the side plate mounting member 1, and the headrest mounting member 2 is fixedly connected to the headrest plate 300 of the sofa through the third fixing hole 21 so as to drive the head plate 300 and the head mount member 2 to move synchronously.

The sofa pillow driving device of the present invention may achieve the opening and retraction of the backrest and headrest of the sofa by cooperation and connection of five components, that is, the side plate mounting member, the headrest mounting member, the rotation limit member, the elastic member and the driving device, with structure simple, manufacture cost low, and being easy to popularize.

In the sofa pillow driving device 100 according to the second embodiment of the present invention, the headrest plate 300 is opened and retracted by the driving device 5 located in the middle of the sofa, ensuring that both ends of the sofa are uniformly stressed, the distance between the two ends of the sofa is almost the same when the headrest plate is opened, the actions of the two ends of the sofa are substantially synchronous when the headrest plate is retracted, and the headrest plate 300 is folded to the position of the backrest.

In addition, the headrest mounting member 2 in the sofa pillow driving device 100 of the present invention can rotate around the rotation limit member 3 by an external force without being affected by the movement of the driving device 5, to prevent the hand from being trapped.

It will be apparent to those skilled in the art that various other changes and modifications may be made in the light of the above teachings and concepts, and all such changes and modifications are intended to be within the scope of the present invention as defined by the appended claims.

The invention claimed is:

1. A sofa pillow driving device comprising a side plate mounting member, a headrest mounting member, and a driving device, characterized in that the sofa pillow driving device further comprises a rotation limit member and an elastic member, the rotation limit member being rotatably connected to the side plate mounting member, the headrest mounting member being rotatably connected to the rotation limit member, one end of the elastic member being connected to the headrest mounting member and the other end being connected to the rotation limit member, one end of the driving device being rotatably connected to the rotation limit member and the other end being rotatably connected to a backrest wood frame, the driving device driving the headrest mounting member to rotate by the rotation limit member;

wherein the rotation limit member is provided with a first rotation connecting hole, the rotation limit member being rotatably connected to the side plate mounting member by a rotation shaft passing through the first rotation connecting hole; and the rotation limit member is further provided with a sliding groove, the side plate mounting member is provided with a first fixing hole, one end of a banking pin being fixed in the first fixing hole and the other end being provided in the sliding groove and being slidable in the sliding groove.

2. The sofa pillow driving device of claim 1 characterized in that the rotation limit member is further provided with a second rotation connecting hole, the headrest mounting member being rotatably connected to the rotation limit member by a rotation shaft passing through the second rotation connecting hole.

3. The sofa pillow driving device of claim 2 characterized in that the head mounting member is provided with a first spring hanging hole, the rotation limit member is further provided with a second spring hanging hole, one end of the elastic member being hanging on the first spring hanging hole and the other end being hanging on the second spring hanging hole.

4. The sofa pillow driving device of claim 3 characterized in that the side plate mounting member is further provided with a third rotation connecting hole, the rotation limit member is further provided with a fourth rotation connecting hole , one end of the driving device being rotatably connected to the side plate mounting member by a rotation shaft passing through the third rotation connecting hole and the other end being rotatably connected to the rotation limit member by a rotation shaft passing through the fourth rotation connecting hole.

5. The sofa pillow driving device of claim 3 characterized in that the rotation limit member is further provided a second fixing hole, a first mounting bracket being fixedly connected to the rotation limit member by the second fixing hole, the first mounting bracket being provided a third rotation connecting hole, the upper end of the driving device being rotatably connected to the first mounting bracket by a rotation shaft passing through the third rotation connecting hole, and the lower end of the driving device being connected to a second mounting bracket that is fixedly mounted on the backrest wood frame.

6. The sofa pillow driving device of claim 1 characterized in that the side plate mounting member is further provided with a plurality of second fixing holes through which the side plate mounting member is fixedly mounted on the backrest wood frame.

7. The sofa pillow driving device of claim 6 characterized in that headrest mounting member is further provided with a plurality of third fixing holes through which a headrest plate is fixedly mounted on the headrest mounting member.

* * * * *